US006948972B2

(12) United States Patent
Laukhuf

(10) Patent No.: US 6,948,972 B2
(45) Date of Patent: Sep. 27, 2005

(54) OVERHEAD LIGHTING SPLITTER

(75) Inventor: Gregg E. Laukhuf, Bryan, OH (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 10/397,596

(22) Filed: Mar. 26, 2003

(65) Prior Publication Data

US 2003/0185003 A1 Oct. 2, 2003

Related U.S. Application Data

(60) Provisional application No. 60/368,002, filed on Mar. 27, 2002.

(51) Int. Cl.[7] ..... H01R 3/00

(52) U.S. Cl. ..... 439/490; 439/489; 439/214

(58) Field of Search ..... 439/490, 489, 439/488, 211, 214, 652; 307/147; 326/226, 249

(56) References Cited

U.S. PATENT DOCUMENTS

| | | | | | |
|---|---|---|---|---|---|
| 4,134,045 | A | | 1/1979 | Quin | 315/324 |
| 4,146,287 | A | | 3/1979 | Jonsson | 339/75 |
| 4,272,689 | A | | 6/1981 | Crosby et al. | 307/147 |
| 4,367,417 | A | | 1/1983 | Casasanta | 307/147 |
| 4,399,371 | A | | 8/1983 | Ziff et al. | 307/147 |
| 4,445,737 | A | | 5/1984 | Long et al. | 339/18 |
| 4,500,796 | A | | 2/1985 | Quin | 307/147 |
| 4,659,161 | A | * | 4/1987 | Holcomb | 439/490 |
| 4,781,609 | A | * | 11/1988 | Wilson et al. | 439/215 |
| 5,174,647 | A | * | 12/1992 | Kelly | 362/221 |
| 5,236,370 | A | * | 8/1993 | King et al. | 439/215 |
| 5,544,025 | A | * | 8/1996 | Bohlool et al. | 362/95 |
| 5,554,049 | A | * | 9/1996 | Reynolds | 439/490 |
| 5,679,016 | A | | 10/1997 | Marder et al. | 439/171 |
| 5,679,023 | A | | 10/1997 | Anderson, Jr. et al. | 439/502 |
| 5,708,554 | A | * | 1/1998 | Liner | 361/104 |
| 5,764,043 | A | * | 6/1998 | Czosnowski et al. | 324/66 |
| 5,810,624 | A | | 9/1998 | Lamb | 439/652 |
| 5,819,405 | A | | 10/1998 | Marder et al. | 29/857 |
| 5,844,763 | A | * | 12/1998 | Grace et al. | 361/111 |
| 5,924,889 | A | * | 7/1999 | Wang | 439/490 |
| 6,078,113 | A | * | 6/2000 | True et al. | 639/490 |
| 6,083,053 | A | * | 7/2000 | Anderson et al. | 439/687 |
| 6,330,144 | B1 | * | 12/2001 | Lee et al. | 361/115 |
| 6,422,884 | B1 | | 7/2002 | Babasick et al. | 439/222 |
| 6,448,899 | B1 | * | 9/2002 | Thompson | 340/815.4 |
| 6,577,243 | B1 | * | 6/2003 | Dannenmann et al. | 340/815.45 |

* cited by examiner

*Primary Examiner*—P. Austin Bradley
*Assistant Examiner*—X. Chung-Trans
(74) *Attorney, Agent, or Firm*—Taylor & Aust, P.C.

(57) ABSTRACT

A lighting system including at least one electrical load, at least one electrical connector, each electrical connector electrically connected to a corresponding electrical load and an electrical splitter electrically connectable to at least one electrical connector. The electrical splitter having a plurality of receptacles, each receptacle configured to receive a corresponding electrical connector and a plurality of visual indicators, each visual indicator uniquely associated with a corresponding one of the plurality of receptacles, each visual indicator indicating a connection of one electrical connector with the corresponding one of the plurality of receptacles.

21 Claims, 3 Drawing Sheets

OVERHEAD LIGHTING SPLITTER

CROSS REFERENCE TO RELATED APPLICATIONS

This is a non-provisional application based upon U.S. provisional patent application Ser. No. 60/368,002, entitled "OVERHEAD LIGHTING CIRCUIT SPLITTER", filed Mar. 27, 2002.

BACKGROUND OF THE INVENTION

1. Field of the Invention

The present invention relates to overhead electrical distribution systems, and, more particularly, to an overhead lighting splitter system.

2. Description of the Related Art

Lighting fixtures are often hard-wired by an electrician requiring considerable skill and labor. For example, lighting fixtures for an industrial environment are connected individually to junction boxes and electrically connected to wiring therein. Lighting fixtures that are thus wired may be connected to a particular phase of electricity, which can be determined by removing a portion of a lighting fixture or plate on a junction box to determine which circuit the lighting fixture is wired to.

Some lighting systems utilize converter adaptors to plug into connectors to thereby switch electrical systems to different phases. These require the use of stacked plug/connectors and in some instances up to five such connectors are utilized. This increases the possibility of poor electrical connections within the stacked connector plug assemblies.

Other solutions include the use of plugs which will mate only with selected receptacles, thereby preventing incorrect connections. While preventing incorrect connections a substantial number of plugs and receptacles are then required to be held in inventory. Regardless of the electrical solution used, an operator must closely inspect the connection to be able to determine the circuit to which a lamp is attached.

What is needed in the art is a system for which a branch circuit determination can be made some distance away from the actual connection.

SUMMARY OF THE INVENTION

The present invention provides an electrical splitter used to split circuits in a overhead lighting system.

The invention comprises, in one form thereof, a lighting system including at least one electrical load, at least one electrical connector, each electrical connector electrically connected to a corresponding electrical load and an electrical splitter electrically connectable to at least one electrical connector. The electrical splitter having a plurality of receptacles, each receptacle configured to receive a corresponding electrical connector and a plurality of visual indicators, each visual indicator uniquely associated with a corresponding one of the plurality of receptacles, each visual indicator indicating a connection of one electrical connector with the corresponding one of the plurality of receptacles.

The present invention advantageously allows an electrician or other observer to determine the branch circuit to which a lighting fixture is connected from the floor even in a high ceiling industrial setting.

Another advantage is that the visual indicator can provide circuit information to an electrician even if no electricity is present in the splitter.

A further advantage of the present invention is that a individual can change a circuit to which a light fixture is connected without disconnecting power to any circuit.

A still further advantage of the present invention is that the connectors on the lighting fixtures may be electrically identical with each other.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
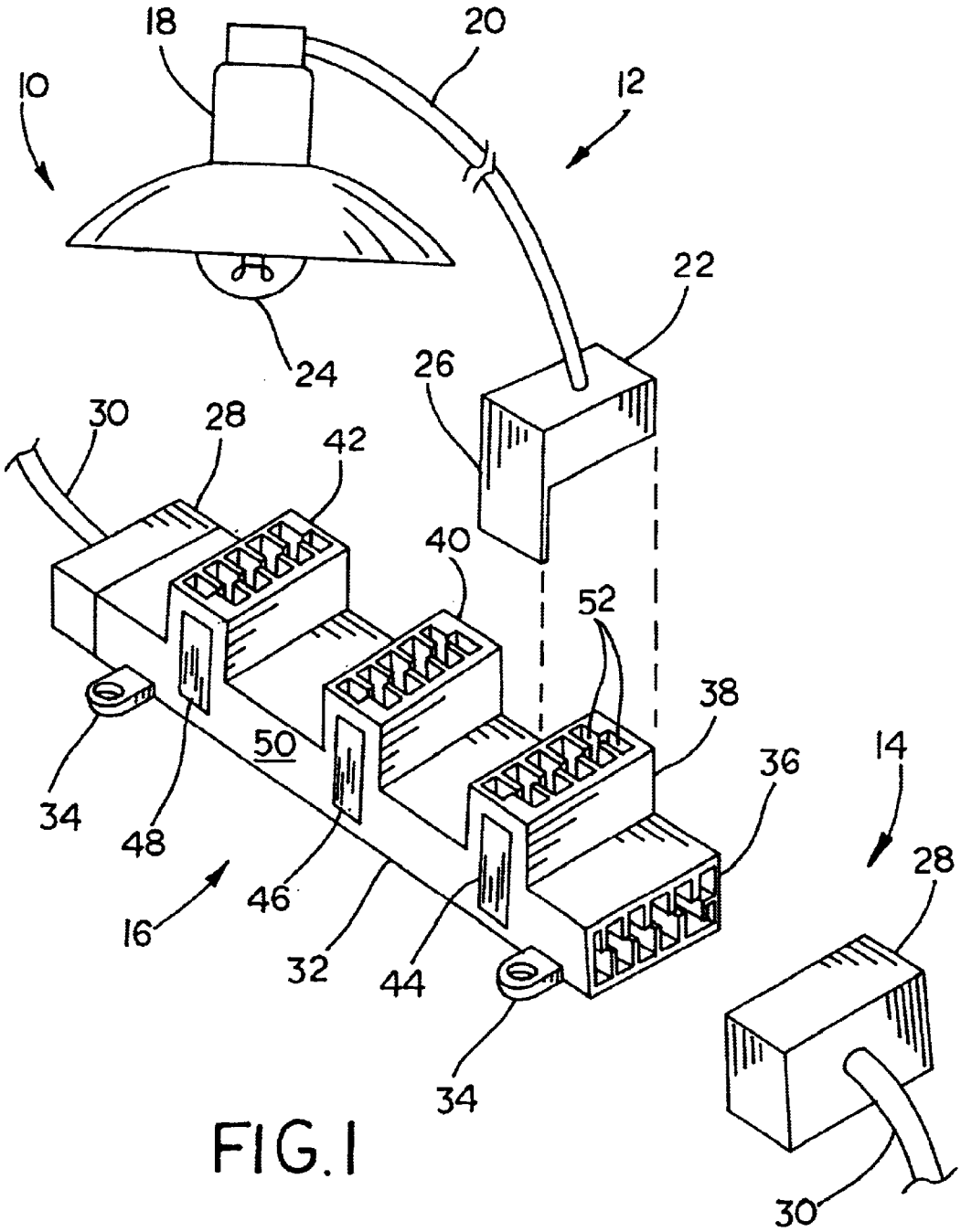
FIG. 1 is a perspective of an embodiment of an overhead lighting splitter of the present invention.

Referring now to the drawings, and more particularly to FIG. 1, there is shown a overhead lighting system 10 which generally includes an electrical load 12, a power transfer assembly 14 and an electrical splitter 16. Electrical load 12, which may be a lamp assembly 12 includes lamp fixture 18, lamp power conductors 20, lamp assembly connector 22 and light bulb 24. Lamp fixture 18 is configured to accept light bulb 24 in a replaceable manner. Lamp power conductors 20 provide at least a power and a power return line to lamp fixture 18 from lamp assembly connector 22.

Lamp assembly connector 22 electrically interfaces with electrical splitter 16 and includes a visual indicator shield 26. Visual indicator shield 26 is configured to at least partially obstruct a visual indicator on electrical splitter 16. Visual indicator shield 26 provides a covering of an otherwise visible indicator to thereby provide information to an observer that a particular circuit is in use. Alternatively, visual indicator shield 26 may be a visual indicator enhancer 26, which optically enhances an underlying visual indicator.

Power transfer assembly 14 includes power transfer connector 28 and power transfer conductors 30. Power transfer assembly 14 has a power transfer connector 28 on each end of power transfer conductors 30 to thereby transfer power from one electrical splitter 16 to another electrical splitter 16. While power transfer connector 28 is shown interconnecting with an end connector of electrical splitter 16, power transfer connector 28 can also connect with any connector on electrical splitter 16. Alternatively, electrical splitter 16 may transfer 3 phases of power to any connector thereon thereby allowing electrical splitter 16 to split power circuits and not just lighting circuits.

Electrical splitter 16 includes housing 32, mounting protrusions 34, power transfer interfaces 36, first receptacle 38, second receptacle 40, third receptacle 42, first visual indicator 44, second visual indicator 46, third visual indicator 48 and housing face 50. Housing 32 may be of modular construction allowing 32 to be snapped, glued or otherwise assembled together. Alternatively, housing 32 may be injection molded as an integral unit. Mounting protrusions 34 allow electrical splitter 16 to be easily mounted on a surface, generally in a ceiling area. Power transfer interfaces 36 are provided on each end of electrical splitter 16, thereby allowing electrical power to be transferred through electrical splitter 16 to another electrical splitter 16 by way of power transfer assembly 14.

First receptacle 38, second receptacle 40 and third receptacle 42 are substantially identical as they are arranged along and attached to housing 32. The positions that are electrically available, known as terminal recesses 52 in receptacles 38, 40, and 42 may be configured to be connected to different phases of electricity that are available in respective locations in each of receptacles 38, 40 and 42 thereby allowing lighting circuits to utilize different phases from a single electrical splitter. Additionally, since there are ten terminal recesses 52 in each of receptacles 38, 40 and 42, not only can a selected phase of electricity be available on a respective position of receptacles 38, 40 and 42, a return line and a ground line can be selected. This leaves seven connections available to be wired so that electrical splitter 16 may transfer power or control signals to other splitters. Alternatively, receptacles 38, 40 and 42 may be wired only to supply separate phases of electricity and passing unused circuits through electrical splitter 16 from one power transfer interface 36 to the other power transfer interface 36.

Along housing face 50 there are situated first visual indicator 44, second visual indicator 46 and third visual indicator 48, respectively, along the sides of receptacles 38, 40 and 42. Visual indicators 44, 46 and 48 may each be a separate color or identical colors. Visual indicators 44, 46 and 48 may include alphanumeric characters. When lamp assembly 12 is electrically connected with electrical splitter 16 by the connecting of lamp assembly connector 22 thereto, as shown in FIG. 1, thereby shielding first visual indicator 44 by the presence of visual indicator shield 26, thereby at least partially blocking first visual indicator 44. In a like manner visual indicators 46 and 48 would be obscured upon the use of receptacles 40 and 42 by other lamp assemblies 12. The information thereby available, to someone standing on the floor of an industrial facility, is to see which circuits are available by way of which visual indicators indicate circuit availability and circuit assignment.

Figure 2:
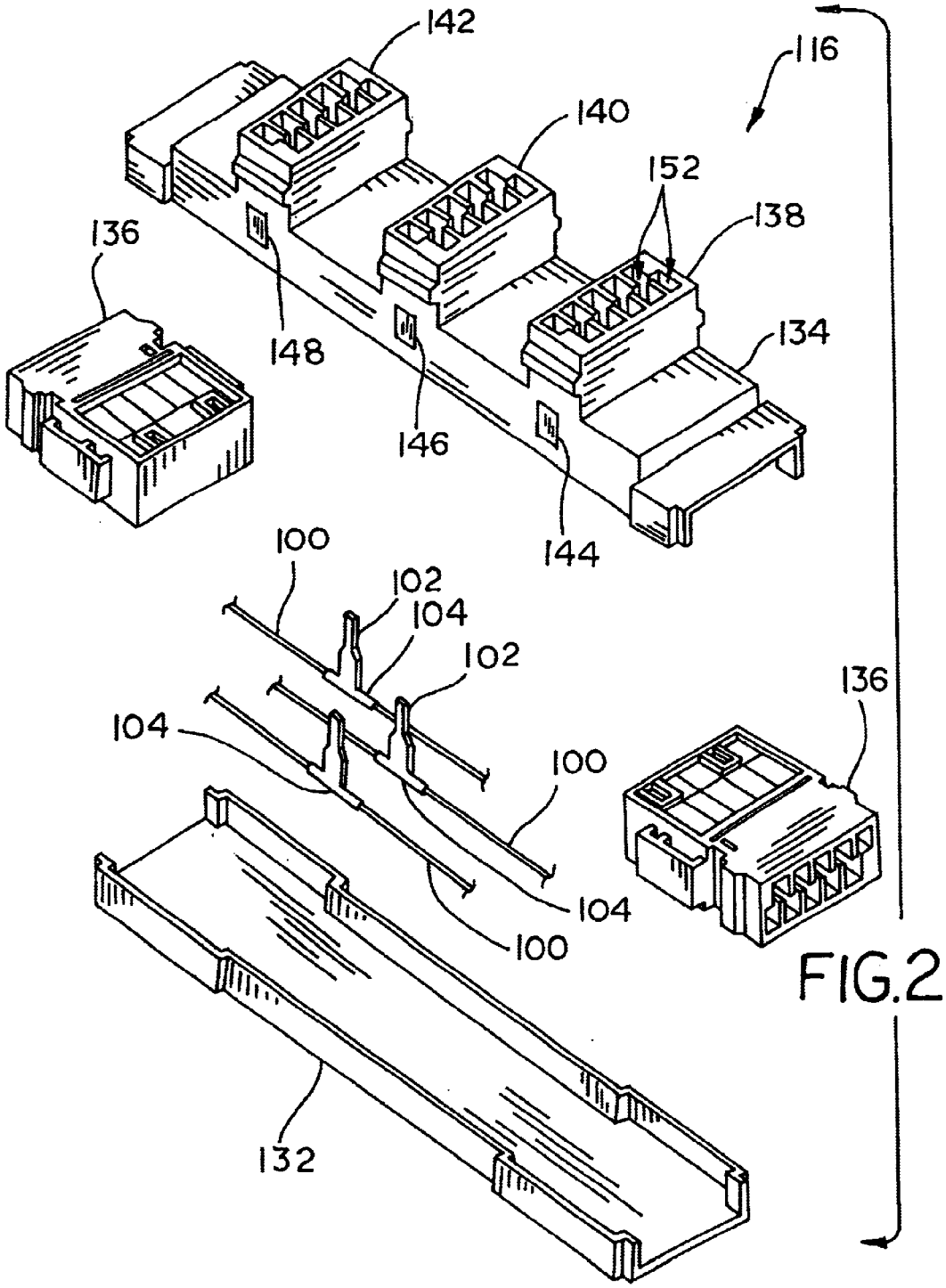
FIG. 2 is an exploded perspective view of another embodiment of the electrical splitter of the overhead lighting system of FIG. 1.

Now, additionally referring to FIG. 2, there is shown an exploded view of another embodiment of an electrical splitter 116 including insulated conductors 100, electrical contacts 102 having a crimp portion 104, housing portion 132, receptacle housing portion 134, connectors 136, a first receptacle 138, a second receptacle 140, a third receptacle 132, a first visual indicator 134, a second visual indicator 146 and a third visual indicator 148. Several portions of the embodiment shown in FIG. 2 are similar to the embodiment shown in FIG. 1 and have numbers associated therewith, which have 100 added to those of FIG. 1.

Insulated conductors 100 transfer power from one connector 136 to another connector 136. Insulated conductors 100 have their insulation pierced by crimp portions 104 of electrical contact 102. Electrical contact 102 is inserted into an appropriate terminal recess 152, in receptacle 136, 138 or 142. Multiple electrical contacts 102 can be crimped by way of crimp portion 104 onto a single insulated conductor 100, thereby allowing common electrical connections between receptacles 138, 140 and 142. An insulated conductor 100 can simply transfer power from one electrical connector 136 to another electrical connector 136 without having any electrical contact 102 installed thereon. Housing portion 132 connects with receptacle housing portion 134 and also connects connectors 136 to thereby form a single assembly embodied as electrical splitter 116. Along a side of receptacle housing portion 134, visual indicators 134, 146 and 148 are electrically energized either when a connector is connected or constantly as long as power is connected to electrical splitter 116.

Figure 3:
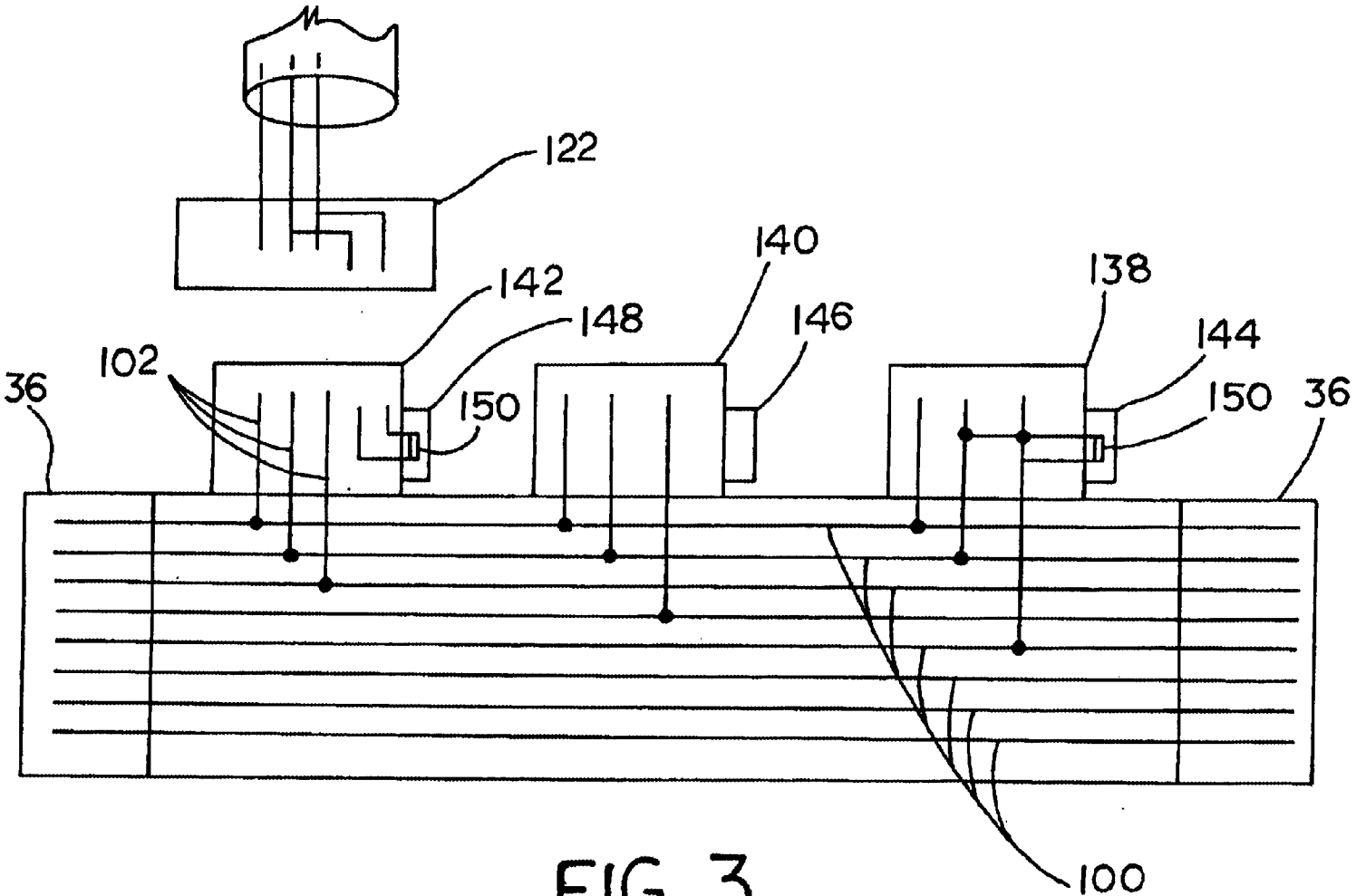
FIG. 3 is a schematicized wiring diagram of the electrical splitters of FIGS. 1 and 2.

Now, additionally referring to FIG. 3, there is shown a schematic view of some of the wiring in electrical splitter 16 or 116. Although three methods are illustrated in FIG. 3, it is anticipated that only one method will be used in each electrical splitter 16 or 116. One mode of illuminating visual indicator 148 is shown in schematic form, related to receptacle 142 in FIG. 3. In this example, when connector 122 is connected to receptacle 142 electrical contacts in connector 122 supply power to visual indicator 148 causing lamp 150 to illuminate, thereby giving a visual indication of a connected live circuit. Second receptacle 140 illustrates second visual indicator 146 as not being powered so when lamp assembly connector 22 is connected thereto, visual indicator shield 26 will block the view of second visual indicator 146. In yet a third mode, first receptacle 138 is shown with visual indicator 144 having a lamp 150, which is illumined whenever power is applied to electrical splitter 16 or 116. Illumined visual indicator 144 can simply be used to indicate an availability of a circuit which does not have a visual indicator shield 26 thereover. In the event that a connector, such as connector 122 that does not having a visual indicator shield 26, is connected to first receptacle 138, then visual indicator 144 simply indicates that a circuit is powered and the observer then looks for an adjacent connector to see if a lamp assembly 12 is connected thereto. As can also be seen in FIG. 3, electrical contacts 102 may be connected to different conductors 100 in electrical splitter 16 or 116.

In using lighting system 10 an installer or maintenance individual places electrical splitters 16 or 116 in positions where lamp assembly 12 are to be wired thereto. Lamp assemblies 12 have sufficiently long power conductors 20 to allow an electrical splitter 116 to be located some distance from the lamp fixture 18. The electrician/maintenance person then obtains power transfer assemblies 14 to interconnect electrical splitter 16 or 116 thereby providing power to each of splitters 16 or 116. Lamp assembly connectors 22 or 122 are then plugged into the desired position on electrical splitter 16 or 116. Once installed, the connection of lamp assembly 12 can be observed from the floor so as to determine which receptacle is being utilized by a particular lamp assembly 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lighting system, comprising:

at least one electrical load;

at least one electrical connector, each said electrical connector electrically connected to a corresponding said electrical load, said at least one electrical connector including an extended portion; and an electrical splitter electrically connectable to at least one said electrical connector, said electrical splitter comprising:

a plurality of receptacles, each said receptacle configured to receive a corresponding said electrical connector; and a plurality of visual indicators, each visual indicator uniquely associated with a corresponding one of said plurality of receptacles, each said visual indicator indicating a connection of one said electrical connector with said corresponding one of said plurality of receptacles, said extended portion interacting with at least one of said plurality of visual indicators when said at least one electrical connector is mated to one of said plurality of receptacles, said extended portion interacting to one of at least partially obscure and at least partially enhanced said visual indicator.

2. The lighting system of claim 1, wherein said extended portion interacts to only at least partially enhance said visual indicator.

3. The lighting system of claim 1, wherein each said visual indicator on said electrical splitter is a separate color from all other said visual indicators on said electrical splitter.

4. The lighting system of claim 1, wherein said plurality of visual indicators are each an illuminated indicator, each said illuminated indicator being electrically connected to at least one electrical terminal in a corresponding one of said receptacles, at least one of said electrical connectors being mated to said corresponding one of said plurality of receptacles thereby completing a circuit causing said illuminated indicator to illuminate.

5. The lighting system of claim 4, wherein each said illuminated indicator on said electrical splitter is a different color from all other illuminated indicators on said electrical splitter.

6. The lighting system of claim 1, wherein said plurality of receptacles include three receptacles each of said three receptacles being respectively connected to a corresponding single phase of a three phase power source.

7. The lighting system of claim 1, further comprising a plurality of electrical contacts, said plurality of electrical contacts connectable to a corresponding one of said plurality of conductors, each said receptacle having a plurality of terminal recesses, each of said plurality of electrical contacts being insertable into a corresponding one of said plurality of terminal recesses.

8. The lighting system of claim 1, wherein said plurality of visual indicators is related to the relative position of each of said plurality of receptacles on said electrical splitter.

9. An overhead light system electrical splitter, comprising:

a housing;

a plurality of receptacles connected to said housing, each of said plurality of receptacles configured to receive an electrical connector associated with an overhead light, said electrical connector having an extended portion; and a plurality of visual indicators, each visual indicator uniquely associated with a corresponding one of said plurality of receptacles, each said visual indicator indicating a connection of said electrical connector with said corresponding one of said plurality of receptacles, when said electrical connector is mated with one of said plurality of receptacles, said extended portion interacts with at least one of said plurality of visual indicators to perform at least one function of partially obscuring and enhancing at least one of said plurality of visual indicators.

10. The splitter of claim 9, wherein said electrical connector is mated to one of said plurality of receptacles thereby at least partially obscuring at least one of said plurality of visual indicators.

11. The splitter of claim 10, wherein each of said plurality of visual indicators is a separate color from all other said plurality of visual indicators on said electrical splitter.

12. The splitter of claim 9, wherein said plurality of visual indicators are each an illuminated indicator, each said illuminated indicator being electrically connected to at least one electrical terminal in a corresponding one of said receptacles, said electrical connector being mated to said corresponding one of said plurality of receptacles thereby completing a circuit causing said illuminated indicator to illuminate.

13. The splitter of claim 12, wherein each said illuminated indicator on said electrical splitter is a different color from all other illuminated indicators on said electrical splitter.

14. The splitter of claim 9, wherein said plurality of receptacles include three receptacles each of said three receptacles being respectively connected to a corresponding single phase of a three phase power source.

15. The splitter of claim 9, further comprising a plurality of electrical contacts, each of said plurality of electrical contacts connectable to a corresponding one of said plurality of conductors, each said receptacle having a plurality of terminal recesses, each of said plurality of electrical contacts being insertable into a corresponding one of said plurality of terminal recesses.

16. The lighting system of claim 9, wherein said plurality of visual indicators is related to the position of each of said plurality of receptacles on said electrical splitter.

17. A method of installing an overhead light system, comprising the steps of:

providing a light fixture having a first end of an electrical cable connected thereto, said electrical cable having a second end with an electrical connector connected thereto, said electrical connector including an extended portion;

connecting said electrical connector to one of a plurality of receptacles on an electrical splitter; and altering at least one visual indicator on said electrical splitter corresponding with one of said receptacles in that when said electrical connector is mated with said receptacle, said extended portion interacts with said at least one visual indicator to perform at least one function of partially enhancing and obscuring at least one visual indicator.

18. The method of claim 17, wherein said altering step is accomplished by said connecting step in that said electrical connector is mated to said receptacle thereby at least partially enhancing said at least one visual indicator.

19. The method of claim 18, wherein each said visual indicator on said electrical splitter is a separate color from other said visual indicators associated with different said receptacles on said electrical splitter.

20. The method of claim 17, wherein said plurality of visual indicators are a plurality of illuminated indicators, each of said plurality of illuminated indicators being electrically connected to at least one electrical contact in a corresponding one of said receptacles, wherein said altering step is accomplished by said connecting step in that said electrical connector is mated to said receptacle thereby completing a circuit causing said illuminated indicator to illuminate.

21. The method of claim 20, wherein said illuminated indicator on said electrical splitter is a different color from all other illuminated indicators associated with other said receptacles on said electrical splitter.

* * * * *